US008220184B2

(12) United States Patent
Albert

(10) Patent No.: US 8,220,184 B2
(45) Date of Patent: Jul. 17, 2012

(54) FOOTWEAR HAVING INTERCHANGEABLE COMPONENTS

(76) Inventor: Andrew Albert, Scarsdale, NY (US)

( * ) Notice: Subject to any disclaimer, the term of this patent is extended or adjusted under 35 U.S.C. 154(b) by 1020 days.

(21) Appl. No.: 12/178,308

(22) Filed: Jul. 23, 2008

(65) Prior Publication Data

US 2010/0018079 A1 Jan. 28, 2010

(51) Int. Cl.
*A43B 3/24* (2006.01)
*A43B 3/12* (2006.01)

(52) U.S. Cl. ..... 36/101; 36/11.5; 36/100

(58) Field of Classification Search ..... 36/11.5, 36/100, 101, 132, 136
See application file for complete search history.

(56) References Cited

U.S. PATENT DOCUMENTS 2,438,711 A * 3/1948 Leach et al. ..... 36/101
2,507,120 A * 5/1950 Shapiro ..... 36/11.5
3,902,259 A 9/1975 Cracco
5,926,978 A * 7/1999 Smith ..... 36/101
6,256,906 B1 7/2001 Matis et al.
6,993,858 B2 2/2006 Seamans
7,222,441 B2 * 5/2007 Smith et al. ..... 36/11.5
7,272,897 B2 * 9/2007 Yu ..... 36/11.5
7,802,381 B2 * 9/2010 Condie ..... 36/101
2003/0088998 A1 * 5/2003 Boncutter et al. ..... 36/11.5
2005/0229435 A1 * 10/2005 Shih ..... 36/101

* cited by examiner

*Primary Examiner* — Khoa Huynh
*Assistant Examiner* — Sharon M Prange
(74) *Attorney, Agent, or Firm* — Daniels Patent Law PLLC; Scott A. Daniels

(57) ABSTRACT

Footwear, namely a shoe or sandal for a human foot fabricated from multiple interchangeable components which can be easily manufactured, assembled and manually replaced and interchanged by the user for purposes of design, repair or changing color and aesthetic coordination and/or component design combinations of the footwear.

10 Claims, 4 Drawing Sheets

FOOTWEAR HAVING INTERCHANGEABLE COMPONENTS

FIELD OF THE INVENTION

The present invention relates to footwear, and particularly to a shoe or sandal for a human foot fabricated from multiple interchangeable components which can be easily manufactured, assembled and manually replaced and interchanged by the user for purposes of design, repair or changing color and aesthetic coordination and/or component design combinations of the footwear.

BACKGROUND OF THE INVENTION

Sandals, including open- and close-toed shoes that include a sole and a strap system for retaining the sole against the bottom of the foot are well known in the art. The most simplistic footwear of this type is often composed of a sole and a toe/forefoot strap into which the user inserts their foot. Other sandals include a heel strap, and a more substantial top piece or "upper" encompassing the forefoot. The upper may fully enclose the foot or it may be open on the sides and/or top and include holes or passages for comfort etc. Examples of footwear in this art include items molded from one piece of material, as well as items built out of several components. In the latter case, the footwear is generally not designed to be disassembled and reassembled by the user. Although of course any footwear may be modified by a cobbler with the use of tools and new or alternative components may be fixed or attached essentially permanently with glue, rivets, nails, or other securing.

The field of footwear is crowded. However, most, if not all, footwear is limited in the sense that there are only limited occasions where any particular piece of footwear is acceptable. Style choices may dictate that a particular item of footwear is appropriate when the user is wearing a certain color of clothing. Further, social customs may dictate that only footwear of a sufficient level of formality (or informality) may be worn to any given event. Also, a user may wish to wear open or partially open toed shoes for comfort, yet some workplaces may require employees to wear fully closed shoes. Thus, the user is forced to purchase, maintain, store, and/or transport a large collection of footwear in order to be prepared for any situation.

The background art reveals, attempts to address this problem. For example, a sandal with interchangeable elements is disclosed in U.S. Pat. No. 3,902,259 to Cracco, issued Sep. 2, 1975. The '259 patent teaches a sandal comprised of several elements which can be replaced for purposes of repair or for change of color combination. However, the sandal of the '259 patent incorporates headless screws that must be adjusted and/or removed with tools in order for parts to be interchanged. Further, reassembling the sandal after disassembly requires the user to stack numerous elements to build the sole while simultaneously ensuring that various circular protrusions are aligned rotationally, horizontally, and vertically with corresponding holes. In sum, the sandal of the '259 patent demands a level of dexterity, coordination, and familiarity with tools that makes it inappropriate for children and others unaccustomed with using tools. Furthermore, such a design requires that the user have those tools with them whenever they desire an interchange, and it further creates the possibility that the screws will become stripped or otherwise stuck in the sandal, thereby rendering the interchangeable nature of the design, and possibly the sandal itself, useless.

The background art is also fundamentally limited in that the size of open-toed shoes and sandals is typically either fixed in length or adjustable via sliding cloth and/or hook-and-loop, Velcro-style straps. Either design choice exhibits flaws. For example, a breathable footwear piece with a fixed length strap can be seen in U.S. Pat. No. 6,993,858 to Seamans, issued Feb. 7, 2006. The strap on each shoe of a given size is identical and fixed in the '858 patent, so users who would like to periodically adjust the length of the strap for a tighter or looser fit of the shoe are unable to do so. In contrast, a piece of footwear that features adjustable straps appears in U.S. Pat. No. 6,256,906 to Matis et al., issued Jul. 10, 2001. As taught, the front strap is partially made of "leather, canvas, or other suitably durable material" that is presumably pliable enough to pass through a clip and bend back over itself to be secured by a clip or a Velcro-style fastener. However, such materials are highly prone to absorbing moisture and perspiration when worn next to the skin, which means their can exhibit foul odors and retain bacteria if not washed regularly. Additionally, hook-and-loop fasteners such as Velcro® tend to accumulate hair and dust after a few months of regular use. The loops can also become elongated or broken over time. Further, hook and loop-style fasteners often become attached to articles of clothing, especially loosely woven items like sweaters. Finally, fastening systems such as those seen in the '906 patent often feature clips and loops that are overly bulky and unsightly. In this case the user is faced with a choice of "one size fits all" or a cumbersome adjustable strap that degrades and becomes unsanitary over time.

OBJECTS AND SUMMARY OF THE INVENTION

The present invention obviates the noted shortcomings and disadvantages of the described prior structures and arrangements. In particular, one object of the present invention is directed to providing footwear made up of individual components which can be readily replaced and recombined for purposes of repair or changing color and/or design combinations.

Another object of the invention provides a means for releasably securing a footwear "upper" composed of individual components to the portion of the shoe in contact with the ground, i.e. the sole. Specifically, an interlocking design for the upper is taught which releasably connects sidewalls of the upper to the sole by means of interlocking fingers and detents, spaced and sized in a manner to allow such interlocking.

Yet another object of the invention provides a means for releasably attaching the aforementioned sidewalls to a top piece, which is also part of the upper and provides stability and an anchor point for the sidewalls and serves to also further define the space and volume in the footwear into which the user's foot is inserted. Specifically, an interlocking design is taught which releasably connects the sidewalls to the top piece by a series of hooks and eyeholes running along the top of the footwear. Those hooks and eyeholes may be engaged to hold the sidewalls and top pieces together.

It is yet another object of the invention to provide a means by which the upper may be anchored to the foot bed in an unobtrusive way, namely by defining a groove in a toe cover that is sized, shaped, and oriented in a manner that a portion of the top piece may pass through it and lie flush in relation to the curved surface of the front of the footwear.

The present invention relates to footwear having interchangeable components for covering the human foot during a variety of activities including a foot bed having a sole for supporting the user's; foot in the footwear, and a row of interlocking fingers and detents extending longitudinally along both sides of the sole and two sidewalls, each having a row of interlocking fingers and detents extending longitudinally along the bottom of the piece, and wherein the elements and fingers are spaced to allow for releasably interfacing of the sidewalls with the foot bed by interlocking the detents of the sidewalls with the fingers of the foot bed, and the fingers of the sidewalls with the detents of the foot bed.

The present invention further relates to footwear for facilitating bipedal motion of a human being, the footwear having interchangeable components having a foot bed for supporting the human being's foot and a first side wall and a second sidewall releasably connected to the foot bed for at least partially encompassing the foot, and wherein the foot bed further comprises a plurality of tabs and slots formed along a portion of an outer edge of the foot bed and the first and second sidewalls each comprising a malting plurality of tabs and slots for releasably engaging with the plurality of tabs and slots on the foot bed.

These and other objects, advantages, and features of the invention will be more readily understood and appreciated by reference to the detailed description of the preferred embodiment and the drawings.

BRIEF DESCRIPTION OF THE DRAWINGS

A further understanding of the various embodiments of the present invention may be realized by reference to the figures which are described in remaining portions of the specification.

DETAILED DESCRIPTION OF THE PREFERRED EMBODIMENTS

The present invention relates to a piece of footwear which is light, stylish and is fabricated from a plurality of interchangeable components. The footwear and its individual components can be made out of a polymer such as rubber or polyurethane foam which is relatively soft, resilient and comfortable on the foot of a user. It will be appreciated that almost any semi-elastic, flexible and resilient material may be used to manufacture the footwear and components of the present invention so long as it accommodates the interlocking and interchangeable features and other aspects of the invention as described in detail below. The component parts may even be fabricated of different materials and also manufactured in a variety of colors, styles, designs, surface textures and sizes in furtherance of the interchangeable aspect of the invention.

Figure 1:
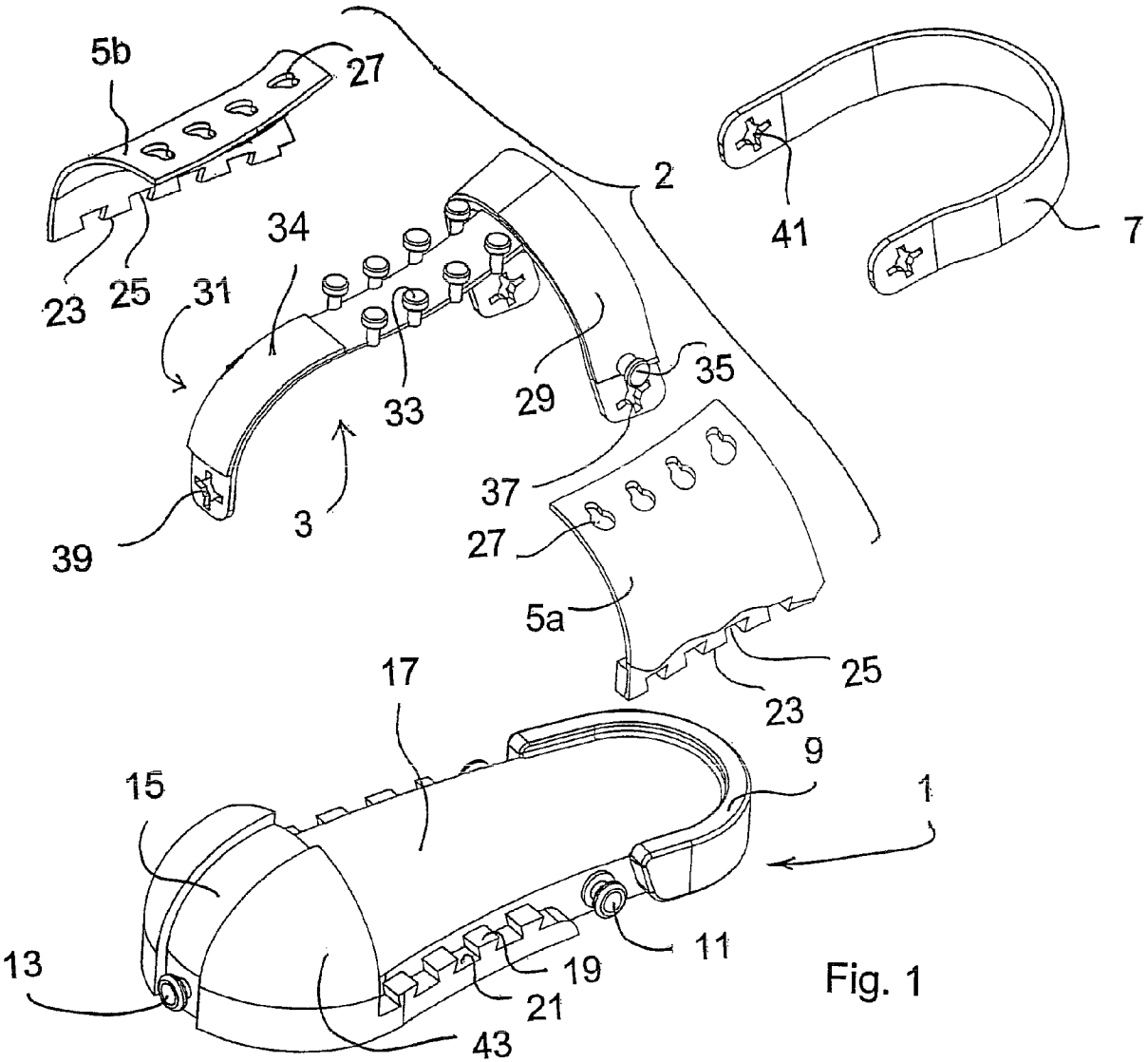
FIG. 1 is an exploded view of the preferred embodiment of the footwear.
Figure 2:
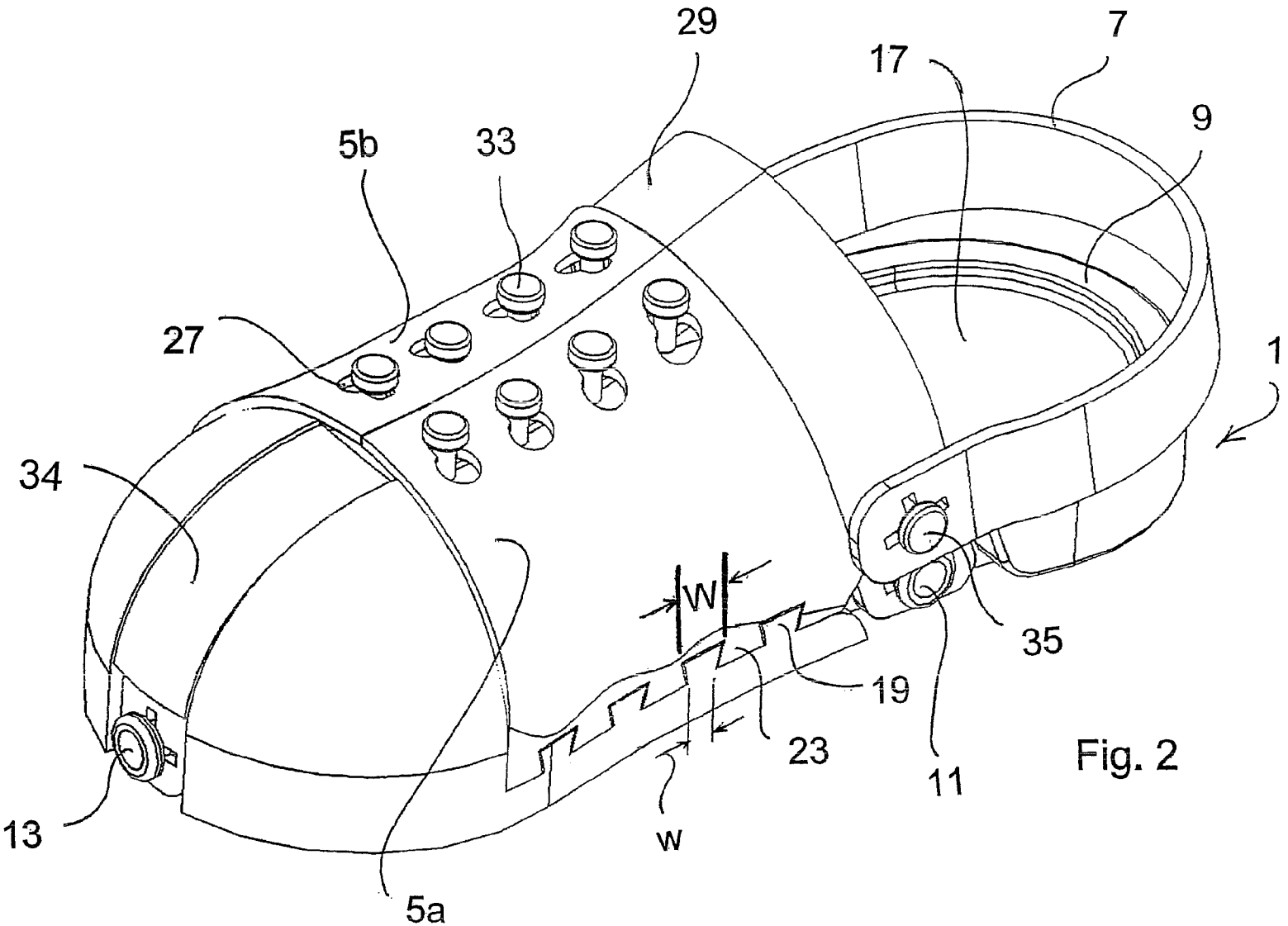
FIG. 2 is a right front perspective view thereof.
Figure 3:
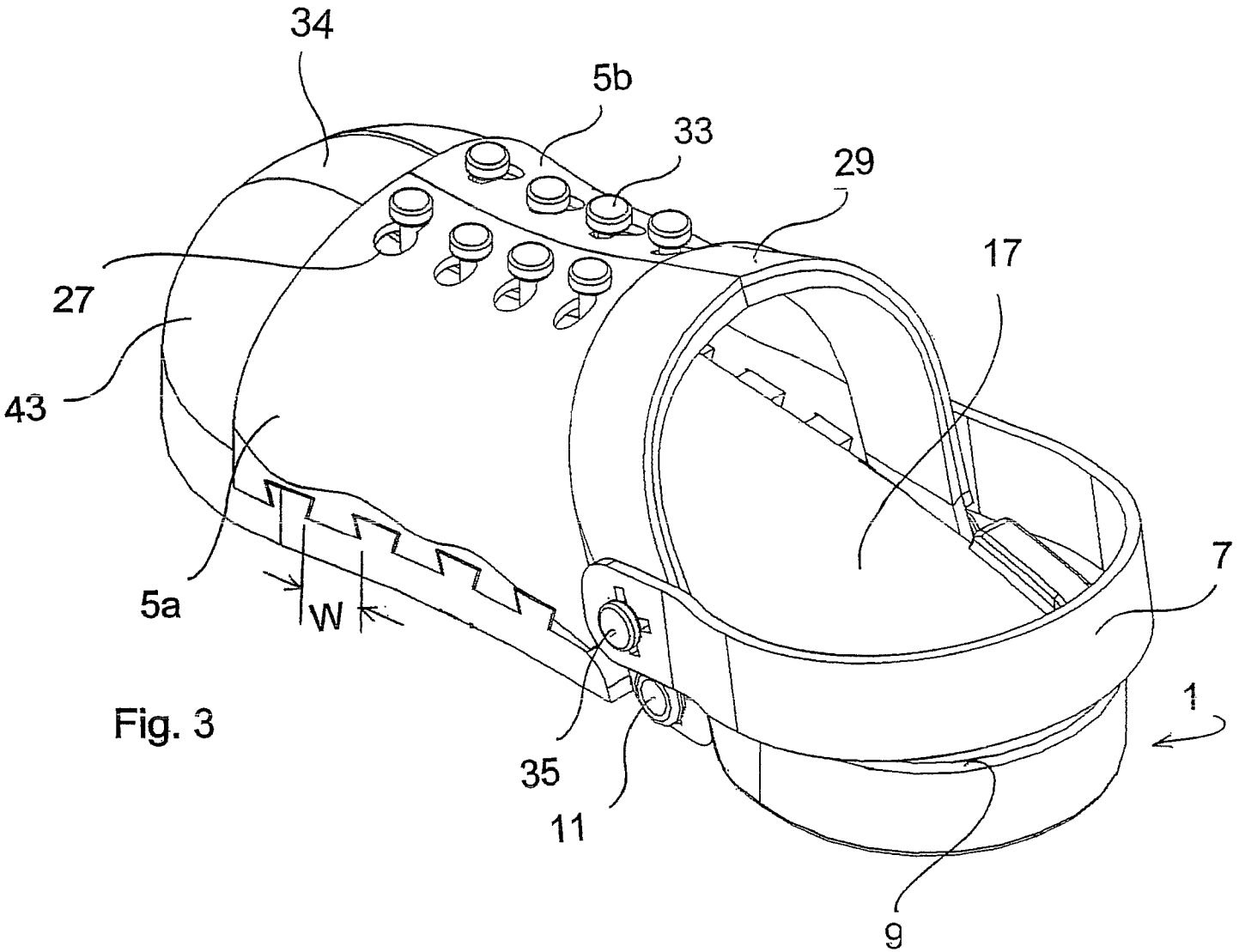
FIG. 3 is a right rear perspective view thereof.
Figure 4:
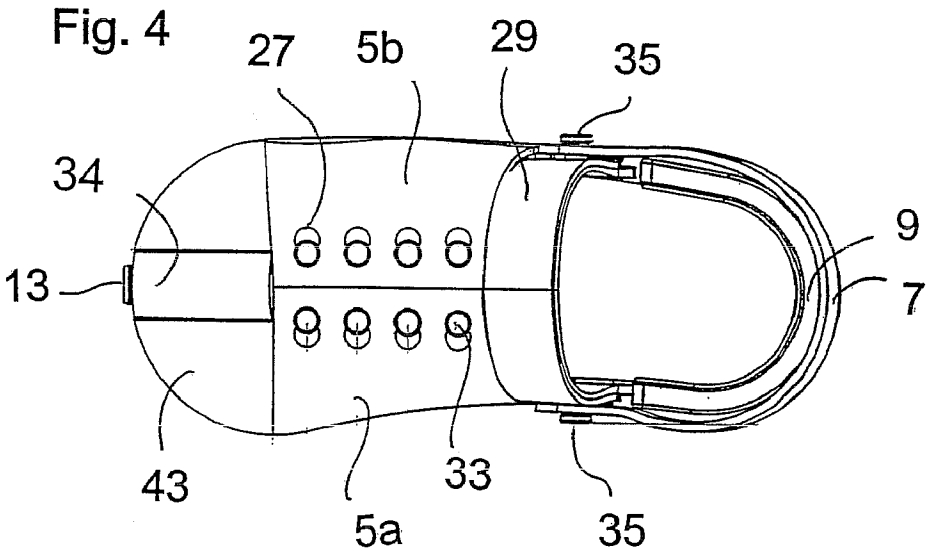
FIG. 4 is a top plan view thereof.

Initially observing FIG. 1, the footwear in accordance with one embodiment is illustrated in an exploded view. In general, the footwear includes a foot bed 1 for directly supporting the sole of a user's foot (not shown) and an upper 2 for retaining the user's foot on top of the foot bed 1 and in the footwear generally. The upper 2 comprises a top piece 3 for securing a number 5*a* components with the foot bed 1. The upper 2 further comprises a first sidewall 5*a* and second sidewall 5*b* which attach between the foot bed 1 and the top piece 3 so as to at least partially encompass a portion of a user's forefoot (not shown). A heel strap 7 may also be provided to assist in further securing the footwear to a user's foot. As shown in FIG. 2 the heel strap 7 has opposite ends rotatably attached to the top piece 3 so that the heel strap 7 has a certain rotational freedom relative to the foot bed 1. However, another embodiment of the footwear could allow the heel strap to attach to one of the fool bed 1, the sidewalls 5*a*, 5*b* and even extend between different components, for example the top piece 3 and the foot bed 1.

The foot bed 1 is built around a sole 17, preferably composed of a rubber or foam material. However, it should be apparent to one of ordinary skill in the art that the sole 17 can be made of any durable material capable of supporting the human foot and bearing the weight of the human body. The sole 17 is generally designed to complement the shape of the human foot, which covers a wide range of shapes and designs due to a wide variety of human foot shapes. Further, it is contemplated that the sole 17 of the foot bed 1 could incorporate topography such as an instep feature to match the sole of the user's foot or even a "high heel" or platform design to elevate the foot for purposes of comfort or style.

The foot bed 1 includes at the front a toe cover 43 mounted to the top of the sole 17 of the foot bed 1. The toe cover 43 can be, but is not limited to, a rounded, hemispherical shape that fully or partially covers and protects the user's toes. Alternately, the toe cover may be outfitted with one or more vents for purposes of decoration or ventilation. Although the toe cover 43 as disclosed in the present embodiment is rounded and hemispherical, it is also contemplated that the toe cover 43 may be made in other shapes different from the present embodiment or even omitted from the design altogether in certain circumstances.

Best seen in FIG. 1, the toe cover 43 further includes a groove 15 running longitudinally along the center of a top surface of the toe cover 43. The groove 15 is formed having a width, depth, and orientation to receive a medial strap 31 of the top piece 3 discussed in further detail below. Ideally, the medial strap 31 will lie substantially flush in the groove 15 with the top surface of the toe cover 43 to prevent the medial strap 31 from sliding laterally along the toe cover 43.

The foot bed 1 is further defined by opposing longitudinal sides which each feature a series of fingers 19 and detents 21 running longitudinally along the sides of the foot bed 1. The fingers 19 and detents 21 essentially form a series of crenelations along the sides of the foot bed 1 with the fingers 19 extending vertically upwardly therefrom to interface with a corresponding series of fingers 23 and detents 25 of the sidewall(s) 5*a*, 5*b* as described in further detail below. The foot bed fingers 19 are created by cutting the series of detents 21 into the sides of the foot bed 1. In order to provide a highly secure connection with the fingers and detents 25 on the sidewalls 5 the foot bed fingers 19 may be cut so that they include a taper from a minimum width w at a lower point of connection to the foot bed 1 to a maximum width W at their upper terminating end to facilitate interlocking as described below.

The preferred embodiment of the foot bed 1 discloses a rear wall 9, comprising a lip extending upwardly along the back and rear portion of the foot bed. This rear wall 9 ideally serves to prevent the user's foot from sliding off the back of the footwear and provide further stability to the sole 17, thereby improving wearability and performance. It may also serve the function to support the heel strap 7 that the heel strap 7 does not fall behind, or below the foot bed. It should be apparent that such a rear wall 9 is integral to foot bed 1 and with the sole 17 of the present embodiment, but that the foot bed 1 could be contemplated both with and without the rear wall 9.

The foot bed 1 of the present embodiment further comprises two side buttons 11, each opposingly located along the sides of the foot bed 1 at a position approximately ⅓ of the way along the longitudinal length of the foot bed 1 forward of the back and rear wall 9 of the foot bed 1. The side buttons 11 have a flat top portion having a larger diameter than a supporting stem connected to the foot bed 1 and extending outwardly therefrom. Each end of a lateral strap 29 of the top piece 3 has a passage, shown here as a cross- or "plus sign"-shaped slit 37 cut into it, such that once the flat top portion is pushed through the slit 37 the end of the lateral strap 29 is secured to the stem of the button 11 and the top piece 3 is held releasably secure in place against the foot bed 1.

Additionally, a front button 13 is positioned extending outwardly from the foot bed 1 and located in the groove 15. This front button 13 similarly comprises a larger flat top portion and a smaller diameter stem. The medial strap 31 of the top piece 3 similarly has a cross-shaped slit 39 which can be passed over the front button 13 so that the top piece 3 is held securely in place against the foot bed 1 and in the groove 15. It is further conceivable that this particular embodiment is not the only means of releasably securing the top piece 3 to the foot bed 1. Other methods and structures by which the ends of the top piece 3 can be releasably clipped, snapped, attached, or anchored to the foot bed 1 may also be contemplated.

The present invention further incorporates the top piece 3, for defining the upper 2 and connecting and stabilizing the first sidewall 5*a* and second sidewall 5*b* with the foot bed 1. The top piece 3 also ensures that the foot bed 1 does not become detached from the rest of the footwear. The top piece is generally a T-shaped configuration, having a lateral strap 29 running laterally from one side of the foot bed 1 to the other. A medial strap 34 is attached at one end to a midpoint of the lateral strap 29 at a point above the medial longitudinal axis of the foot bed 1 and extends forward, in the direction of the toe cover 43, to a free end having a cross-shaped slit 39 at the free end. The lateral strap 29 also has a cross-shaped slit 37 at each end, which interfaces with a side foot bed button 11 as described in detail below. The medial strap 34 similarly has the cross-shaped slit 39 at the distal end for interfacing with the front foot bed button 13 as also described below. A preferred embodiment of the medial strap 34 further has a plurality of hooks 33 or tabs extending upwardly and spaced apart along each side edge of a portion of the length of the medial strap 34 for purposes of interfacing with eyeholes 27 of the sidewalls 5*a*, 5*b* and securing the sidewalls 5*a*, 5*b* to the top piece as described in further detail below.

The top piece 3 also features a button 35 proximal to the slit 37 at each end of the lateral strap 29 for purposes of rotatably securing the free ends of the heel strap 7. The top portion of the button 35 has a larger diameter that a stem portion of the button 35 and each end of the heel strap 7 has a cross- or "plus sign"-shaped slit 41 cut into it, such that once the top portion of the button 35 is pushed through the slit 41 the heel strap 7 is held rotatably and releasably in place against the top piece 3.

As will be apparent to one of ordinary skill in the art, however, the button 35 of this specific embodiment is riot the only means of attachment contemplated by this invention. Any method by which the heel strap 7 can be releasably clipped, attached, snapped or anchored to the footwear is contemplated. Furthermore, the shape and orientation of the top piece 3 can be altered to accommodate a design excluding toe cover 43. For example, a narrow top piece 31 sized to fit over or between the user's big toe and the next toe in a manner emulating the strap on traditional sandals or flip flops is also contemplated. Without the toe cover 43, it is to be appreciated that the top piece 31, and in particular the medial strap 34, would become much like a traditional flip-flop strap with the end of the medial strap 34 being attached, by a button or snaps etc. directly to the foot bed 17 of the footwear. The attachment might not occur directly in the centerline of the footwear as shown in the Figures, but might be offset towards the inside of the footwear so as to be aligned more directly between the big toe and the second toe of a user.

As discussed above, the footwear of the present invention further comprises a first sidewall 5*a* and a second sidewall 5*b* which attach to the foot bed 1 to form the upper 2 of the footwear. Each sidewall 5*a*, 5*b* features a series of fingers 23 and detents 25 running longitudinally along its bottom, with the sidewall fingers 23 depending downwardly therefrom to interface cooperatively with the detents 21 in the side of the foot bed 1. The upper portion of these sidewalls 5*a*, 5*b* may be of any thickness or material desired, however the sidewall fingers 23 should be of substantially identical thickness as the foot bed fingers 19 in order to facilitate interlocking of the sidewall fingers 23 and detents 25 with the foot bed fingers 19 and detents 21.

The sidewall fingers 23 are created by cutting the series of detents 25 along a lower edge of each sidewall 5*a*, 5*b*. Again, the detents 25 and hence the fingers 23 are cut such that the sidewall fingers 23 are tapered from a minimum width w at their point of connection to the foot bed 1 to a maximum width W at their flat termination end to facilitate interlocking with the complementary tapering fingers 19 and detents 21 in the foot bed as described below.

The side walls 5*a*, 5*b* of the present embodiment further comprise eyeholes 27 aligned and running along the length of the top edge of the sidewall. The eyeholes 27 are offset from the top edge of the sidewall to prevent tearing of the material at the shortest point between the eyeholes 27 and the top edge of the sidewalls 5*a*, 5*b*. The sidewalls 5*a*, 5*b* are also sized and shaped in such a manner that the top edge of the first sidewall 5*a* and the top of the second sidewall 5*b* are substantially aligned and parallel medially down the top of the upper 2. Any gap therebetween is minimized to exclude the entry of foreign objects into the footwear and for general aesthetic purposes. Other attachment designs could be possible as well such as using a hook-and-loop style fastener, snaps or other attachment mechanisms to attach each sidewall to the top piece 3. With the use of snaps, the snaps could be replaceable/interchangeable and of different colors depending upon design preference.

As discussed above, the components of the above described footwear are interchangeable and easily manually attached and released from any desired configuration while still ensuring that the footwear remains stable and solidly affixed so as not to come apart while in use on a user's foot. The interchangeability of the components can be further enhanced by manufacturing certain components for every size of the footwear the same size. For example the side walls 5*a*, 5*b* could be made the same size within the whole, or even a partial, range of sizes so that the side walls 5*a*, 5*b* could be interchanged with another person's footwear even if the two user's sizes were different. This would enable users to exchange footwear side walls with one another even where there were differences in shoe size.

The footwear and components are now functionally described in accordance with the above described structure. The series of fingers 19 and detents 21 along each side of the foot bed 1 define an interface with the fingers 23 and detents 25 of the sidewall 5. The detents 21 in the foot bed 1 define spaces for receiving fingers 23 which depend downwardly from sidewall 5. The foot bed fingers 19 and the sidewall fingers 23 are of substantially the same width and aligned in an offset staggered manner such that, when the sidewall 5 and the foot bed 1 are properly aligned, the foot bed fingers 19 and the sidewall fingers 23 will interlock. The interlocking of these fingers 19, 23 is facilitated because both the foot bed fingers 19 and the sidewall fingers 23 are tapered from a minimum width w at the point from which they extend from their respective bodies to a maximum width W at their flat termination end.

Figure 5:
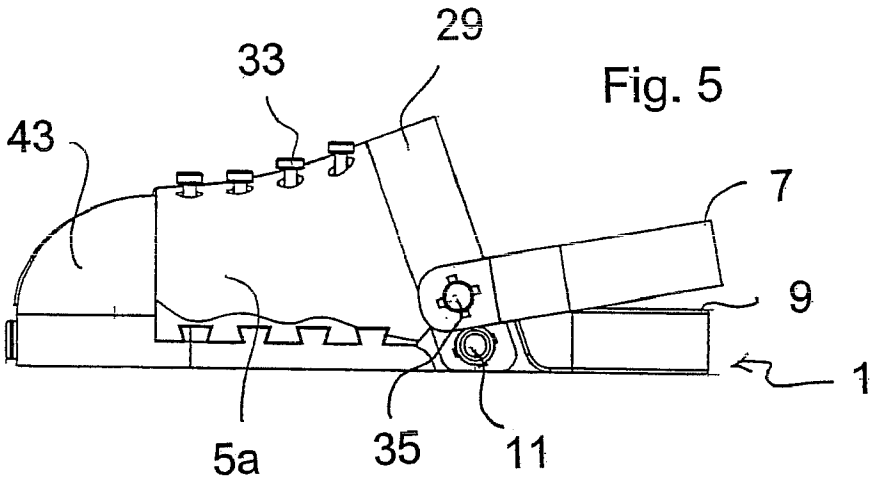
FIG. 5 is a side elevational view thereof.
Figure 6:
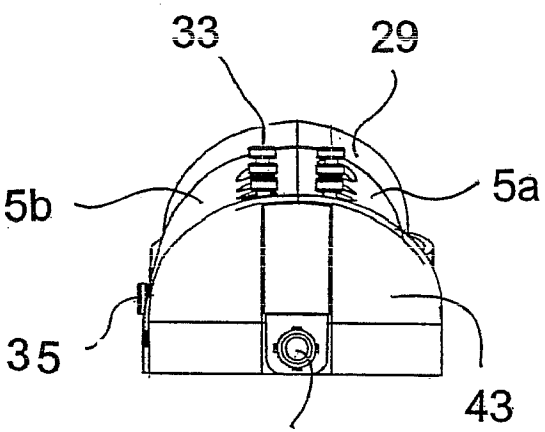
FIG. 6 is a front elevational view thereof.

This allows the foot bed fingers 19 and the sidewall fingers 23 to interlock by aligning the respective opposing fingers and detents and applying a lateral force to frictionally engage the fingers 23 on the lower edge of the sidewall 5*a*, 5*b* with the fingers 19 on the foot bed 1. When this is done the sidewall(s) 5*a*, 5*b* slides into a position immediately perpendicular over the portion of the foot bed containing the foot bed fingers 19. The fingers 19 and 23 thus interlock as discussed above and as seen in FIGS. 2 and 5.

Thus, in the ordinary course of use the fingers 19, 23 will be retained in an interlocked position by virtue of their shape, and will resist detaching under normal amounts of upward force. A person of ordinary skill in the art will recognize this aspect as integral, since a piece of footwear experiences upward force as the user pushes off the ground with his or her foot during the course of normal bipedal movement. When it is desired that the fingers disengage from one another, a slight amount of lateral force is used to slide sidewall 5 out and away from the foot bed 1. This sort of lateral force is not experienced during normal bipedal movement. Therefore, the sidewall 5 and the foot bed 1 resist being separated during use when such separation is undesirable, but easily come apart when the user wishes to substitute or remove parts from the footwear.

It should be noted that the number, shape, and arrangement of the fingers as described above are only one embodiment of the present design; it would be apparent to one of ordinary skill in the art that any of a number of finger shapes and configurations would perform the same function, and are contemplated and claimed herein. For example, fingers that extend upwardly from the foot bed and bend at a right angle toward the front or back of the footwear would work just as well, as would fingers that extend upwardly at an acute angle from the foot bed. The specific shape of the fingers is immaterial, so long as the detachably interlocking nature of them as described here is realized.

Since certain changes may be made in the above described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. Footwear having interchangeable components for covering the human foot during a variety of activities, comprising:

a foot bed having a sole for supporting the user's foot in the footwear, and a row of interlocking fingers and detents extending longitudinally along both sides of the sole;

a first sidewall and a second sidewall, each having a row of interlocking fingers and detents extending longitudinally along the bottom of the piece;

a heel strap that releasably attaches to the footwear and extends behind the user's foot for purposes of maintaining the user's foot in the footwear;

a toe cover for purposes of covering some portion of the distal end of the user's foot;

portions defining a groove running axially down the front of the toe cover; a top piece releasably secured laterally and vertically to the foot bed and within the groove, and;

wherein the detents and fingers are spaced to allow for releasably interfacing of the sidewalls with the foot bed by interlocking the detents of the sidewalls with the fingers of the foot bed, and the fingers of the sidewalls with the detents of the foot bed.

2. The footwear according to claim 1, further comprising a means of releasably connecting the first sidewall to the second sidewall along the top of each respective sidewall at a point spaced vertically above the foot bed to allow for maintaining the user's foot in the footwear.

3. The footwear according to claim 2, further comprising a plurality of one of hooks and eyes formed along the top of the first sidewall and along the top of the second sidewall wherein the first sidewall and second sidewall can be releasably attached to each other by engaging the hooks and eyes.

4. The footwear according to claim 1, wherein the sidewalls can be releasably attached to the top piece to allow for maintaining the user's foot in the footwear.

5. The footwear according to claim 4, further comprising one of a plurality of hooks and eyes along the top of each sidewall and the other of the plurality of hooks and eyes along each side of the top piece wherein the first sidewall and second sidewall can be releasably attached to the top piece by engaging the hooks and eyes.

6. The footwear according to claim 1 wherein the heel strap is pivotable relative to the first sidewall and second sidewall to allow adjustments in the position of the heel strap relative to the user's heel for purposes of comfort.

7. The footwear according to claim 6 further comprising a button on either side of the foot bed and an opening in either end of the heel strap for releasably mounting the heel strap to the foot bed.

8. Footwear for facilitating bipedal motion of a human being, the footwear having interchangeable components comprising:

a foot bed for supporting the human being's foot;

a first sidewall and a second sidewall releaseably connected to the foot bed for at least partially encompassing the foot;

wherein the foot bed further comprises a plurality of tabs and slots formed along a portion of an outer edge of the foot bed and the first and second sidewalls each comprising a mating plurality of tabs and slots for releaseably engaging with the plurality of tabs and slots on the foot bed a toe cover for purposes of covering some portion of the distal end of the user's foot; portions defining a groove running axially down the front of the toe cover;

wherein the first and second sidewalls each further comprise one of a plurality of key holes and keys along a top edge for adjoining the first and second sidewalls overtop and spaced from the foot bed, and;

a front foot strap secured to the outer edge of the foot bed and within the groove and having the other of the plurality of key holes and keys for securing the first and second sidewalls to the front foot strap.

9. A method of making footwear having interchangeable components for covering the human foot during a variety of activities, comprising the steps of:

forming a foot bed having a sole for supporting the user's foot in the footwear, and defining a row of interlocking fingers and detents extending longitudinally along both sides of the sole;

fabricating a first sidewall and a second sidewall separate from the foot bed, and forming a row of interlocking fingers and detents extending longitudinally along the bottom of the piece;

releasable connecting the first sidewall and the second sidewall along the top of each respective sidewall at a point spaced vertically above the foot bed to allow for maintaining the user's foot in the footwear;

providing a toe cover for purposes of covering some portion of the distal end of the user's foot;

fabricating a groove running axially down the front of the toe cover; providing a top piece releasably secured laterally and vertically to the foot bed and within the groove, and;

spacing the detents and fingers to allow for releasably interfacing of the sidewalls with the foot bed by interlocking the detents of the sidewalls with the fingers of the foot bed, and the fingers of the sidewalls with the detents of the foot bed.

10. The method of making footwear having interchangeable components according to claim 9, further comprising the step of forming a plurality of one of hooks and eyes along the top of the first sidewall and along the top of the second sidewall wherein the first sidewall and second sidewall can be releasably attached to each other by engaging the hooks and eyes.

* * * * *